US006003745A

United States Patent [19]

Mechanic

[11] Patent Number: 6,003,745

[45] Date of Patent: Dec. 21, 1999

[54] DUAL PURPOSE SURFBOARD BAG

[76] Inventor: Jonah Mechanic, 307 Rosemont St., La Jolla, Calif. 92037

[21] Appl. No.: 08/890,237

[22] Filed: Jul. 9, 1997

Related U.S. Application Data

[60] Provisional application No. 60/021,509, Jul. 10, 1996.

[51] Int. Cl.[6] ..... A45C 9/00

[52] U.S. Cl. ..... 224/156; 206/315.1; 5/420

[58] Field of Search ..... 224/607, 907, 224/917, 156; 206/315.1, 522, 523; 383/3, 4; 5/413 AM, 420

[56] References Cited

U.S. PATENT DOCUMENTS

| | | | |
|---|---|---|---|
| D. 337,432 | 7/1993 | Caffloro . | |
| 4,483,380 | 11/1984 | Beran | 206/315.1 |
| 4,723,300 | 2/1988 | Aranow | 383/4 |
| 5,033,497 | 7/1991 | Hernandez | 206/315.1 X |
| 5,094,344 | 3/1992 | Savage | 206/315.1 |
| 5,152,018 | 10/1992 | Lea | 5/420 |
| 5,404,600 | 4/1995 | DeMars | 5/420 X |

*Primary Examiner*—Renee S. Luebke
*Attorney, Agent, or Firm*—Robert M. Schwartz

[57] ABSTRACT

This invention encompasses a dual-purpose surfboard bag. The first function of the bag is to carry a surfboard in a manner that is convenient and protective. The second function of the bag is to provide a cushion for sleeping. In its preferred embodiment, the invention utilizes self-inflating air mattresses within a durable bag to perform both functions.

4 Claims, 1 Drawing Sheet

DUAL PURPOSE SURFBOARD BAG

CROSS-REFERENCES TO RELATED APPLICATIONS

This application claims the benefit of U.S. Provisional application No. 60/021,509, filed Jul. 10, 1996.

BACKGROUND OF THE INVENTION

This invention relates to an improved surfboard bag used to store a surfboard of the type used in surfing of waves generally in close proximity to a beach. Surfboards are generally manufactured in a variety of sizes, such that an individual surfer's surfboard will match the surfer's style, weight, and height. A typical surfboard will be slightly bowed lengthwise, 4 to 7 feet in overall length, approximately 2 feet in width, approximately 2 to 3 inches thick, and have at least one fin which may or may not be detachable. Surfboards are usually made of a foam core covered in fiberglass. Accordingly, surfboards are fragile and susceptible to being damaged from external forces when stored in a surfboard bag for travel purposes.

Those who use and participate in the sport of surfing e.g. surfers, often find it necessary or desirable to travel to a suitable beach to obtain the best or different surfing conditions. Whether the travel is a long distance or shorter across town, surfers may transport their boards and, therefore, want to protect the surfboards during travel. Whether said travel is in a car or other personal transportation means, or using commercial transportation such as on an airplane, travel necessitates the packaging of the surfboard in a container. Said containers are known as surfboard bags. However, as will be seen, nothing in the prior art protects a surfboard in the manner of the present invention. In addition, the prior surfboard bags do not provide an additional dual purpose as a comfortable pad for sleeping.

Prior Art

U.S. Pat. Des. No. 337,432, issued to Cafloro on Jul. 29, 1993, discloses a surfboard cover that does not show or teach the advantages of the present invention.

SUMMARY OF THE INVENTION

The present invention comprises a surfboard travel bag containing self-inflatable air mats that serve a dual purpose. First, the disclosed invention serves as a protective travel bag for a surfboard. Second, the invention serves as a sleeping mat for the surfer. The present surfboard bag is adapted for receiving a surfboard and holding it safely in place within a protective covering. The present surfboard bag uses two self-inflating mats within the surfboard bag. These self-inflating mats are used as padding for protecting the surfboard. In addition to protection, they serve as the sleeping mat portion when the surfboard bag is used as a sleeping mat.

The surfboard bag has a top pad and a bottom pad. The two pads are congruently shaped. The two pads are joined permanently along an elongated edge. The elongated edge connects the coinciding parts of the top pad and the bottom pad. The remainder of the edge of the top pad and bottom pad are releasably attached by a means that allows the bag to be opened and closed. The shape of the pad is similar to that of a surfboard's horizontal surface. The similar shapes of the pads and the surfboard hold the surfboard securely and prevent the board from rattling within the bag.

The surfboard bag contains self-inflating mats: one for the top pad and one for the bottom pad. These self-inflating mats are comprised by a resilient, compressible, open-celled foam, an air-tight PVC jacket that surrounds the foam, and a valve in the PVC jacket that when opened allows air to enter or escape the PVC jacket. In its inflated state, the resilient, open-celled foam has a shape that supports the PVC jacket. In its inflated state, the valve is kept closed. When the valve is closed, the PVC is air tight and acts like an air mattress.

The self-inflating mats are easily collapsed. To collapse the mats for convenient storage, the valve is opened. When the valve is opened, air can escape the mat. The mat can then be rolled up like a sleeping bag. As the mat is rolled, the foam is compressed. In this way, a 1" thick non-compressed mat can be compressed to ⅛" thick compressed mat. Once the mat is compressed and rolled the valve is closed. The closed valve seals the PVC jacket. Because the PVC jacket is air-tight, the mat is unable to reinflate so it remains in a compressed shape.

A deinflated, self-inflating mats is able to return to its original shape on its own. To reinflate, the valve must be opened. The foam, being resilient, will return to its original shape. As the foam return to its shape, the surrounding PVC jacket will also conform. As the volume increases, air enters the PVC jacket through the valve. Once the foam has decompressed, the valve is closed sealing the PVC jacket. The sealed mat then acts as an air mattress.

The two mats are used in each surfboard travel bag—one on the top and the other on the bottom. The two mats protectively sandwich the surfboard on the top and the bottom. The mats are enclosed within the two pads: the top pad and the bottom pad. The outer surfaces of each pad are covered with a high-denier fabric. The inside surfaces of each pad, that come into contact with the surfboard, are covered with a nylon fabric.

Each pad is covered with fabric and stitched together along the edges. About two fifths (⅖) of the circumference of the surfboard bag contains a continuous zipper. The zippered opening allows the user to open the surfboard bag, separate the two pads, insert the surfboard, and close the surfboard bag by zipping it. The surfboard is stored between the two inflated foam mats which are held in place within the top and bottom pads. The self-inflating mats act as air cushions. In this manner, the surfboard bag serves as superior protection for the surfboard from the elements commonly encountered while traveling.

The second use of this surfboard bag is as a sleeping mat. Whether the user is camping outside or sleeping on a floor, once inflated, the surfboard travel bag would serve as a comfortable sleeping surface.

Finally, the dual-purpose surfboard bag, when not being used as a surfboard bag or a sleeping, can be deflated for convenient storage. To store the bag, the self-inflating mats merely have to be deflated and the whole bag rolled up. The surfboard bag in its rolled-up state requires less storage space.

Objects of the Invention

It is an object of this invention to provide a dual-purpose surfboard bag to contain and protect a surfboard during travel.

It is another object of this invention to provide a surfboard bag that can be used as a comfortable sleeping mat.

It is yet another object of this invention to use self-inflating mats in a surfboard bag.

It is another object of the present invention to make a dual purpose surfboard bag that is easy to use and that is economical to manufacture.

DESCRIPTION OF THE PREFERRED EMBODIMENT

The details of a preferred embodiment of this invention will be better understood in the light of a description thereof that follows, particularly when the reader follows the set of drawings that forms part of this description.

Figure 1:
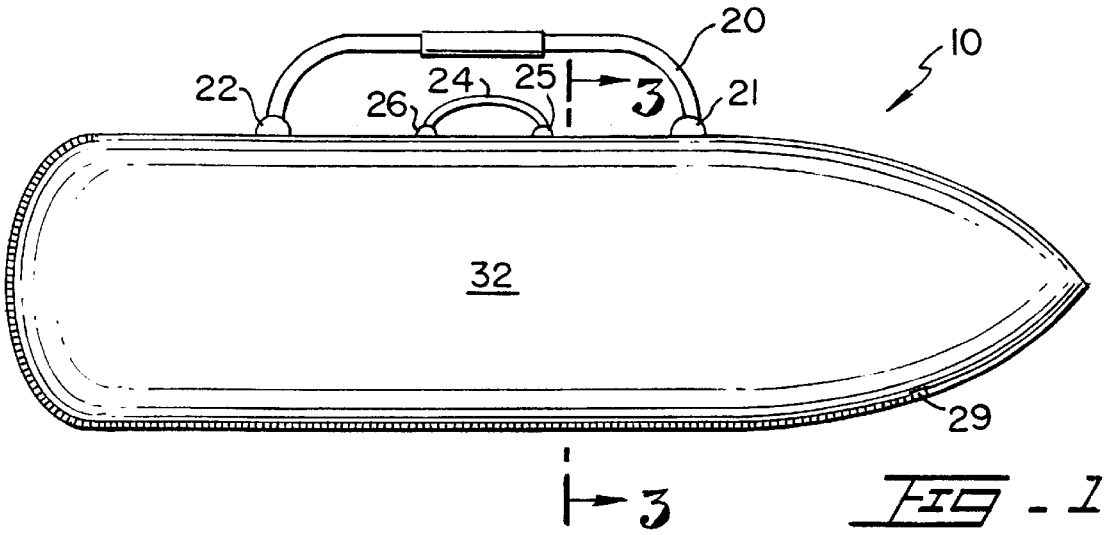
FIG. 1 is a plan view of a surfboard travel bag.

The surfboard bag 10 of the present invention is shown in FIG. 1 in a closed position with shoulder strap 20 having connecting means 21 and 22 for attaching said strap 20 to the surfboard bag 10 and the reinforced shoulder strap 23. The surfboard bag includes a hand strap 24 with connecting means 25 and 26 for attaching the strap 24 to the surfboard bag 10.

Surfboard bag 10 includes a zippered opening of approximately ⅖ of the circumferential edge of the surfboard bag 10. The zippered opening provides means to insert and remove a surfboard 30 into and from the surfboard bag 10. The Surfboard 30 typically has one or more fixed or removable fins 31. A fastener means, having a first row 27 and a second row 28 of teeth with a sliding zipper 29, provides a closing/opening means for said surfboard bag 10 along the circumferential edge opening of said surfboard bag 10. Sliding zipper 29 slides in a generally clockwise direction (as seen in FIGS. 1 and 2) to close surfboard bag 10 and in a counter-clockwise direction to open surfboard bag 10.

Figure 2:
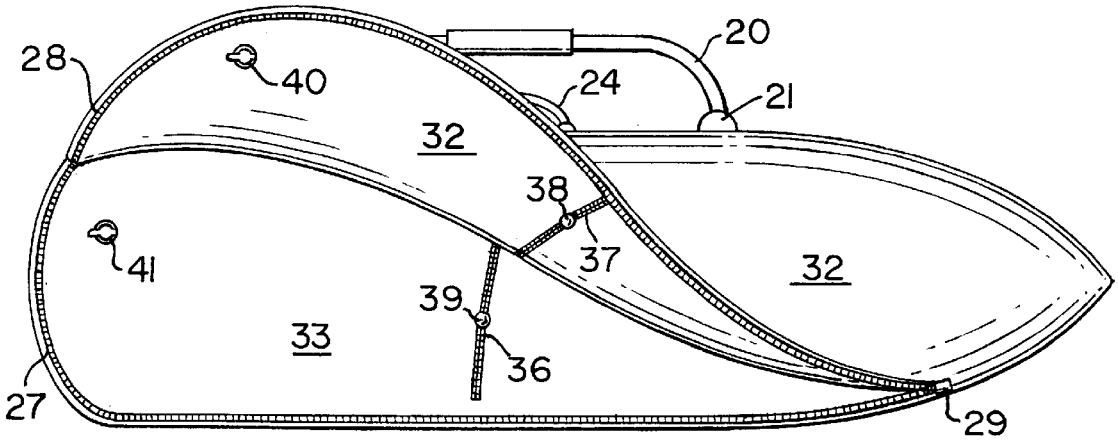
FIG. 2 is a plan view similar to FIG. 1 showing the bag with the zipper in a partial open position and the top pad in an open position.
Figure 3:
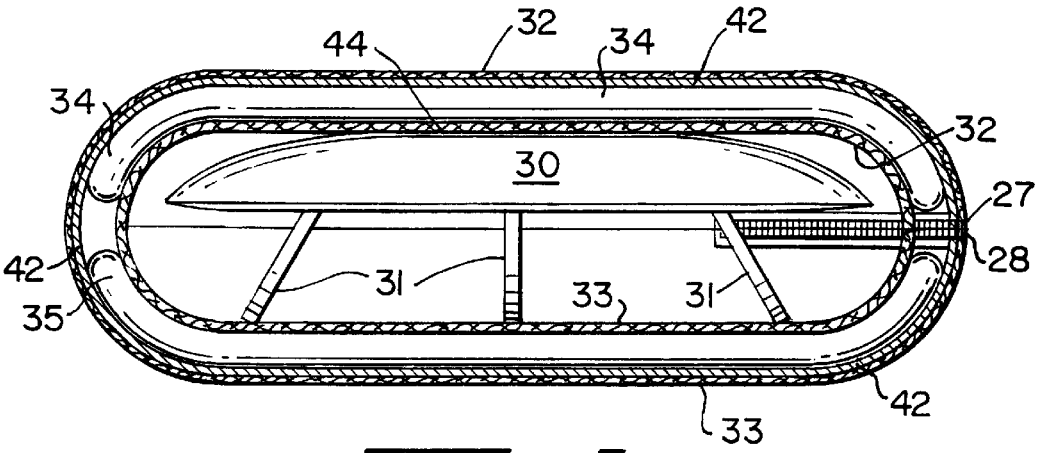
FIG. 3. is a cross-section view taken along section line 3—3 in FIG. 1, showing the surfboard bag holding a surfboard, and the relationship of the board with the foam mats.

When the surfboard bag is in the opened position, as shown in FIG. 2, the surfboard bag has sufficient room to insert a surfboard 30 or remove said surfboard. Preferably, each surfboard bag 10 is custom designed to correspond to a particular surfboard in size and shape characteristics. Alternatively, the surfboard bags 10 of the present invention could be distributed and manufactured according to one of several predetermined sizes and shapes. As shown in FIG. 3, the surfboard bag 10 is designed such that the surfboard 30 will fit into the surfboard bag 10 in a snug or relatively close fitting manner. Though a surfboard 30 is not shown in FIG. 2, the surfboard 30 would run the length of surfboard bag 10. Likewise, the width of surfboard 30 would approximately correspond to the width of surfboard bag 10. Surfboard bag 10 includes a top pad 32 and a bottom pad 33. The horizontal surfaces of each pad are parallel to the surfboard. The horizontal surface of the pads 32 and 33 are shaped like the surfboard's horizontal surface 44. The surfboard's horizontal surface 44 is the surface on which the surfer stands when riding the surfboard. The pads 32 and 33 are permanently connected by an elongated edge 43. In addition, the pads 32 and 33 are releasably attached to each other by a fastener means, having a first row 27, and a second row 28 of teeth with sliding zipper 29. The zipper 29 opens and closes the surfboard bag 10 to allow a surfboard 30 to be inserted and removed from the bag. An outer fabric made of high-denier material covers the outer surfaces of the surfboard bag 10 including the outer portions of pad 32, and pad 33. Preferably, this material is extremely durable so as to protect the surfboard and the outer surfaces of surfboard bag 10 from the elements.

The inner material of the bag is nylon.

Top pad 32 and bottom pad 33 contain separate self-inflating mats: top mat 34 and bottom mat 35, respectively. In addition, the top pad 32 and bottom pad 33 contain a layer of polyethylene foam 42 between said mats 34 and 35 and outer fabrics 32 and 33.

The self-inflating mats 34 and 35 are comprised by one-inch-thick, resilient, open-celled foam, an airtight PVC jacket, and a valve 40 and 41. The PVC jacket surrounds and encloses the resilient open-celled foam. The valves 40 and 41 are located in the PVC jacket and, when opened, they allow air to enter or exit the PVC jackets.

Mat 34 is the shape and size of top pad 32 and is removably located within said top pad 32. Likewise, mat 35 is the shape and size of bottom pad 33 and is removably located within said bottom pad 33, as seen in FIG. 2. A second fastener means 36 and a third fastener means 37 are located inside surfboard bag 10 towards the middle of pads 32 and 33, respectively. Each of said fastener means 36 and 37 have two rows of teeth with a sliding zipper 38 and 39 respectively. These openings formed from said second and third fastener means provide a closure/opening means for inserting and removing self-inflating mats 34 and 35 respectively. One could remove mats 34 and 35 in the case of damage to the mat for repair. Additionally, each mat 34 and 35 includes an air valve 40 and 41, respectively, to connect each said mat to the outside air environment through pad 32 and pad 33, for releasing air and for inflation. These valves 40 and 41 work in a conventional manner to provide a valve to be opened and closed, providing a means in which air can enter and exit the self-inflating mats.

Between each mat 35 and its corresponding outer bottom pad 33 and mat 34 and outer top pad 32, a layer of polyethylene foam 42 provides an additional layer of protection for board 30.

In use, surfboard bag 10 can be stored in a rolled-up position, preferably bound or securely held in said rolled up position. When the surfboard bag 10 is to be used, valves 40 and 41 are opened to allow air into mats 34 and 35. A surfboard 30 would be loaded into surfboard bag 10, and zipper 29 closed, thus securing surfboard 30 in place. After travel is completed, the surfboard bag 10 can be rolled up again by opening valves 40 and 41, squeezing or otherwise depressing the self-inflating foam mats 34 and 35 and pushing the air out of each mat and then closing valves 40 and 41 to prevent air from entering self-inflating foam mats 34 and 35 again.

Alternatively, the surfboard bag can be used as a sleeping mat. By opening valve 40 and/or 41 depending on the amount of cushioning desired, the mats 33 and 34 can be inflated. Next, the valves 40 and 41 are closed. Then, the surfboard bag 10 can be used as an air mattress on which to sleep.

Conforming to the provisions of the patent statutes, applicant has provided an explanation of the principle, preferred construction and mode of operation of this invention and has illustrated and described what is no considered to be its best embodiment. It is understood, however, that within the scope of the claimed subject matter that follows, the invention may be practiced otherwise than as specifically illustrated and described.

I claim:

1. A dual-purpose surfboard bag for use with a surfboard comprising:

a top pad, a bottom pad, a common elongated edge connecting said top pad and said bottom pad, a releasable attachment means releasably attached to said top pad and said bottom pad so as to allow said dual-purpose surfboard bag to be opened and closed, and a mat contained within said bottom pad by a fastener means, and wherein said mat is surrounded by an airtight PVC jacket.

2. A dual-purpose surfboard bag for use with a surfboard comprising:

a top pad, a bottom pad, an elongated edge connecting said top pad and said bottom pad, a releasable attachment means releasably attached to said top pad and said bottom pad so as to allow said dual-purpose surfboard bag to be opened and closed, and a mat contained within said bottom pad by a fastener means, wherein said mat is inflatable, and wherein said mat comprises:

resilient, open-celled foam roughly in the shape of a horizontal surface of said surfboard, an airtight PVC jacket that surrounds said resilient, open-celled foam, and a valve that when open allows said mat to inflate and deflate and when closed seals said mat.

3. A dual-purpose surfboard bag for use with a surfboard comprising:

a top pad wherein said top pad is shaped like a horizontal surface of said surfboard and has an exterior that is covered with high-denier fabric and interior of said top pad contains a layer of foam, a bottom pad wherein said bottom pad is shaped like the horizontal surface of said surfboard and has an exterior that is covered with high-denier fabric and the interior of said bottom pad contains a layer of foam, an elongated edge connecting said top pad and said bottom pad, a zipper means releasably attached to said top pad and said bottom pad so as to allow said dual-purpose surfboard bag to be opened and closed, a top mat contained within said top pad, wherein said top mat comprises:

resilient, open-celled foam roughly in the shape of said horizontal surface of said surfboard, an airtight PVC jacket that surrounds said resilient, open-celled foam, and a valve that when opened allows said mat to inflate and deflate and when closed seals said top mat, a bottom mat contained within said bottom pad, wherein said bottom mat comprises:

resilient, open-celled foam roughly in the shape of said horizontal surface of said surfboard, an airtight PVC jacket that surrounds said resilient, open-celled foam, and a valve that when opened allows said mat to inflate and deflate and when closed seals said bottom mat, a shoulder strap connected to said elongated edge, a hand strap connected to said elongated edge, and polyethylene foam located between said top mat and said top pad and between said bottom mat and said bottom pad.

4. A dual-purpose surfboard bag for use with a surfboard comprising:

a top pad, a bottom pad, an elongated edge connecting said top pad and said bottom pad, a top mat attached to said top pad, a bottom mat attached to said bottom pad, wherein said top mat and said bottom mat each comprise:

resilient, open-celled foam, an airtight jacket surrounding said resilient, open-celled foam, and a valve that when opened allows said mat to inflate and deflate and when closed seals said mat, and wherein said airtight jacket is made of PVC.

* * * * *